United States Patent [19]

Kohlen

[11] Patent Number: 4,564,228

[45] Date of Patent: Jan. 14, 1986

[54] APPARATUS FOR MAKING TENSION-PROOF JOINT FOR ENDLESS-FIBER THREADS

[75] Inventor: Karl-Heinz Kohlen, Monchen-Gladbach, Fed. Rep. of Germany

[73] Assignee: W. Schlafhorst & Co., Monchen-Gladbach, Fed. Rep. of Germany

[21] Appl. No.: 535,368

[22] Filed: Sep. 23, 1983

[30] Foreign Application Priority Data

Sep. 23, 1982 [DE] Fed. Rep. of Germany ..... 3235135

[51] Int. Cl.[4] ..... B65H 69/00

[52] U.S. Cl. ..... 289/2; 242/35.6 R; 289/18.1

[58] Field of Search ..... 289/2, 18.1; 242/35.6 R

[56] References Cited

U.S. PATENT DOCUMENTS

| | | | |
|---|---|---|---|
| 3,377,676 | 4/1968 | Fürst | 289/2 X |
| 3,643,990 | 2/1972 | Horatschke et al. | 289/2 X |
| 3,838,875 | 10/1974 | Franzen | 289/18.1 |

FOREIGN PATENT DOCUMENTS

| | | | |
|---|---|---|---|
| 2142175 | 6/1973 | Fed. Rep. of Germany | 282/2 |
| 47-35632 | 9/1972 | Japan | 289/2 |

*Primary Examiner*—Louis K. Rimrodt

*Attorney, Agent, or Firm*—Herbert L. Lerner; Laurence A. Greenberg

[57] ABSTRACT

A tension-proof thread joint, includes two endless threads pointing in different directions, the threads having ends lying adjacent each other in lengthwise direction thereof forming a common thread end with an end section, the common thread end being twisted through one and one-half turns forming a loop with a thread eye formed therein, and the end section of the common thread end being extended through the thread eye to prevent untwisting of the common thread end.

17 Claims, 21 Drawing Figures

FIG. 14
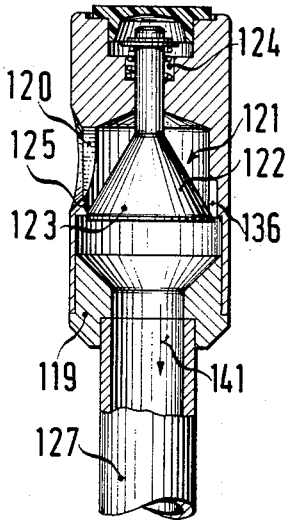
FIG. 16
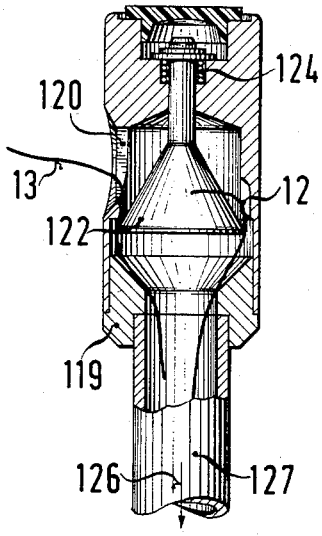
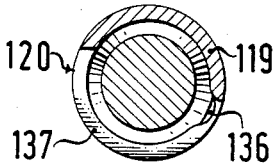
FIG.15
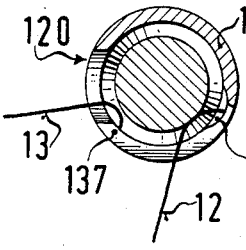
FIG.17
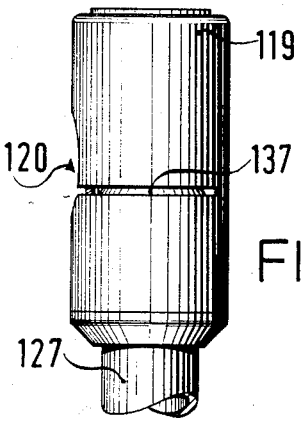
FIG.13

APPARATUS FOR MAKING TENSION-PROOF JOINT FOR ENDLESS-FIBER THREADS

The invention relates to a tension-proof joint in endless-fiber threads which point in different directions, the threads having ends which lie side by side along their length and thereby form a common thread end, as well as a method for making the joint, and an apparatus for implementing the method.

At least two endless fiber threads are to be joined together. In the working and processing of thread it is often necessary to make a durable thread joint. This is the case, for instance, when changing unwinding bobbins in a bobbin creel for warping machines. Since the endless fibers are usually very smooth, have a low friction coefficient and frequently are formed of materials which have a lubricating effect with sliding friction, extraordinary difficulties are encountered in forming a durable thread joint which adds to the thickness as little as possible, is inconspicuous and is simple to make.

It is accordingly an object of the invention to provide a tension-proof joint for endless-fiber threads which overcomes the hereinafore-mentioned disadvantages of the heretofore-known products of this general type, which is durable, can be produced in a simple manner, quickly, and at the same time with a minimum of technical expenditures, especially when changing unwinding bobbins in a bobbin creel.

With the foregoing and other objects in view there is provided, in accordance with the invention, a tension-proof thread joint, comprising two endless threads pointing in different directions, the threads having ends lying adjacent each other in lengthwise direction thereof forming a common thread end with an end section, the common thread end being twisted through one and one-half turns forming a loop with a thread eye formed therein, and the end section of the common thread end being extended or pushed through the thread eye as an obstruction to prevent untwisting of the common thread end.

In order to form the joint, there is provided a method which comprises forming a loop in the common thread end, subsequently twisting the loop through one and one-half turns until the common thread end has crossed over itself three times as seen from the side and a thread eye is formed, and pulling the end section of the common thread end through the thread eye to preserve the one and one-half turns of the twisted common thread end.

As an alternative in forming the joint, there is provided a method which comprises forming a loop in the common thread end, subsequently twisting the loop until the common thread end crosses over itself two times as seen from the side and a thread eye is formed, twisting the end section of the common thread end with the loop until the common thread end crosses over itself a third time with one and one-half turns, and pulling the end section of the common thread end through the thread eye to preserve the one and one-half turns of the twisted common thread end.

The invention provides, among other things, the advantage of being able to form the joint easily, quickly and simply, with a margin of safety against pulling apart which exceeds the tensile strength of the threads, and without expending a large amount of effort in making the joint.

In accordance with another mode of the invention, there is provided a rotatable tying bill having a controlled thread clamp, which comprises placing the common thread end behind the tying bill, rotating the tying bill between one and one-half and two turns to perform the step of forming the thread eye and the necessary twist of the common thread end, subsequently opening and closing the thread clamp while continuing to rotate the tying bill, gripping and holding the end section of the common thread end with the thread clamp, stopping the rotation of the tying bill, pulling the thread eye off the tying bill, and performing the step of pulling the end section of the common thread end through the thread eye.

The necessary twist referred to above is either twisting with one and one-half turns or twisting with one turn. However, as the tying bill continues to rotate, the missing half turn is made up by crossing the end section of the thread end during or after the seizure by the thread clamp. In both cases, a twist with one and one-half turns must be in existence at the latest when the end section of the thread end is pulled through the thread eye.

The production of the thread joint by means of a tying bill is particularly well suited for automating the operations.

In order to carry out the method and form the joint, there is provided an apparatus for forming tension-proof joints in endless threads pointing in different directions, comprising a program control device for coordinating operation of the apparatus, a device connected to the program control device for finding, fetching and holding the threads and for forming a common thread end with the ends of two threads lying adjacent each other in lengthwise direction, a joining device having a tying bill connected to the program control device for twisting the common thread ends of the threads into thread loops or thread eyes, a thread clamp of the tying bill for holding the common thread ends at least during rotation of the tying bill, a device connected to the program control device for placing the common thread ends behind the rotatable tying bill for twisting, and a device connected to the program control device for pulling the thread loops or eyes in the common thread ends off the tying bill.

In accordance with another feature of the invention, there is provided a device for opening and closing the thread clamp, being combined with the device for pulling off the thread loops or eyes.

The device for finding, fetching and holding the threads and for forming a common thread end should be viewed as a unified device. Since a special term is lacking for this device, it is designated according to the features of its activity.

In accordance with a further feature of the invention, the device for finding, fetching and holding the threads and for forming the common thread end, includes a movable thread suction head having a suction opening formed therein and a controlled thread clamping device.

In accordance with an added feature of the invention, the controlled thread clamping device is in the form of a pneumatic valve activated by negative pressure. Advantageously, mechanical elements for actuating the thread clamping device are eliminated. Suction air is already available, and the underpressure of the suction air is utilized for actuating the thread clamping device.

In accordance with an additional feature of the invention, the pneumatic valve is disposed in vicinity of the suction opening.

The pneumatic valve can respond to the underpressure either directly or indirectly in the form of a servo valve. In both cases, the valve is opened only if the underpressure is present and a thread can actually be sucked up.

The placement of the pneumatic valve in vicinity of the suction opening eliminates the necessity of requiring a thread or a thread end to first travel a fairly long distance to reach the thread clamping device, which in the worst case would means a loss of time.

In accordance with again another feature of the invention, the pneumatic valve includes a valve seat, and a valve disc having a rim, the valve disc being spring-loaded for biasing the rim against the valve seat and the rim being lifted off the valve seat by negative pressure, or suction air flow.

The lifting therefore takes place in the flow direction. The flow conditions are particularly favorable if, in accordance with again a further feature of the invention, the valve disc is a cone being tapered against flow direction of the negative pressure. With this shape of the valve disc, the sucked-up thread is accelerated in every case in the direction of the opened valve gap. The thread also cannot easily stick to the valve disc.

In accordance with again an added feature of the invention, there is provided a suction air source, a controlled valve connected to the suction air source, and a hollow body connected from the controlled valve to the thread suction head.

In accordance with again an additional feature of the invention, the hollow body is a movable line or hose.

In order to make it possible for the device for finding, fetching and holding the threads and for forming a common thread end, to collect the individual threads successively, in accordance with yet another feature of the invention, the movable line is a pivotable pipeline.

The suction head can now pick up, suck up and hold the individual threads successively by means of the pivotable pipeline.

In fetching threads of different thickness, rather different retention forces can be observed. It may therefore be advisable to hold one or another thread in such a manner so that it does not interfere with or prevent the holding of a further thread. In order to make this possible, in accordance with yet a further feature of the invention, the valve seat has a recess formed at a given location therein for preventing a thread from being clamped, and the thread suction head has a thread guiding slot formed therein from the suction opening to the recess.

It is then possible to first suck up a thread and to clamp it between the valve disc and the valve seat, and to then move the thread suction head to another location to pull off the thread either from a bobbin or from a thread brake or the like. However, when the thread suction head is moved away, the sucked-up thread is already sliding along in the thread guide slot, and if another thread is sucked up at another point, the thread which is sucked up first enters the recess of the valve seat where, although still being held by suction air, is no longer clamped.

In accordance with yet an added feature of the invention, the thread clamp of the tying bill is in the form of clamping scissors including a first outer bill part having a cutting edge, a tiltable middle knife having a dull back and a tilting device, and a second outer bill part having dull edges. If the common thread end comes between the middle knife and the two outer bill parts, then the thread end is cut off at the one wide side of the middle knife when the latter closes, but is only clamped against the second outer bill part at the other wide side of the middle knife which has a dull back. Such a construction has the advantage of shortening overly long end sections of the thread end to an advantageous minimum length.

In accordance with yet an additional feature of the invention, there are included side walls having stationary guiding slots formed therein, the device for placing the common thread ends behind the tying bill including two pivotable insertion arms disposed laterally of the tying bill and interacting with the guiding slots for determining the position of the common thread end. The thread end can be prepositioned in the thread guiding slots by the device for finding, fetching and holding the threads and for forming a common thread end. The further transport downward into the bottom of the thread guiding slots is then accomplished by the device for inserting the thread end behind the tying bill. The latter device is then in its base or rest position. This therefore assures that the common thread end always occupies the same position which is favorable in relation to the tying bill, before the twisting is started.

In accordance with still another feature of the invention, the device for pulling the thread loops or eyes off the tying bill includes two thread guiding vanes being movable up and down in vicinity of the tying bill, and including a strap interconnecting the thread guiding vanes.

In accordance with still a further feature of the invention, the tilting device includes two switching vanes, the strap is in the form of a device for opening and closing the thread clamp having an opening formed therein defining a rim, the tying bill is extended through the opening with the switching vanes of the tilting device at the level of the opening, and the rim of the opening forms a guiding contour for the switching vanes. The opening and closing of the thread clamp then takes place in such a way that the device for pulling-off the loop from the tying bill is moved either up and down or back and forth. The middle knife is actuated depending on the position of the switching vanes of the middle knife relative to the direction of motion of the device for pulling-off the loop. Accordingly, it is also not necessary for the device for pulling-off the loop to actually have a loop to be pulled off with each of its motions. The loop can be pulled off the tying bill if it is already formed and if the tying bill has occupied a position favorable for pulling-off.

When forming the thread joint, it is advantageous to add or to retain a certain amount of thread tension for the threads. To this end, in accordance with still an added feature of the invention, there is provided a controlled thread clamp or brake disposed at a given location where the threads form the common thread end. The controlled thread clamp need only be closed when the common thread end is formed. The same applies to a thread brake. However, it is not absolutely necessary for a thread brake to be controllable if it is possible to introduce the threads laterally between brake discs when the common thread end is being formed.

In accordance with a concomitant feature of the invention, the program control device includes a combined cam and gear transmission. It is known in the prior art to assemble program control devices from gear and cam transmissions. Such program control devices are very rugged, not disturbance-prone and inexpensive. Apart from this, the program control device may also be of a different construction. It may be equipped, for instance, with electromechanical or electronic elements.

Other features which are considered as characteristic for the invention are set forth in the appended claims.

Although the invention is illustrated and described herein as embodied in a tension-proof joint for endless-fiber threads, a method for making the joint and an apparatus for implementing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the acoompanying drawings, in which:

FIG. 13 is a fragmentary elevational view of a thread suction head;

FIGS. 14 and 15 are respective longitudinal-sectional and cross-sectional views of the thread suction head according to FIG. 13, with the valve closed;

FIGS. 16 and 17 are respective fragmentary, partly longitudinal-sectional and partly cross-sectional views of the thread suction head according to FIG. 13, with the valve open.

Figure 1:
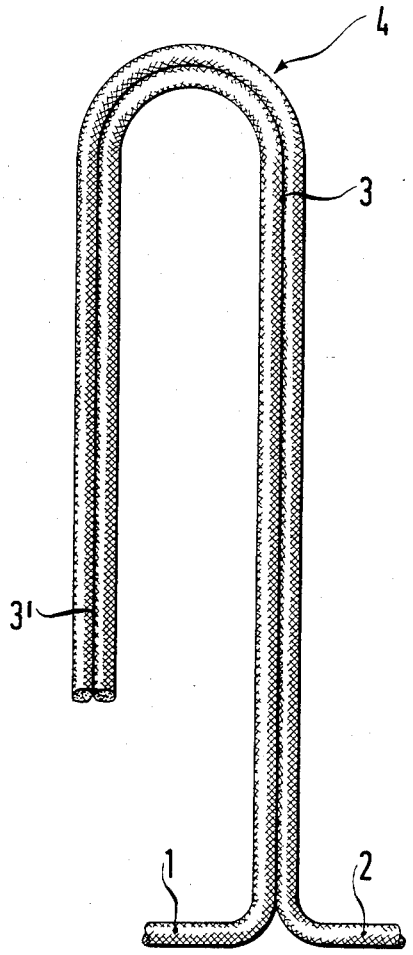
FIGS. 1 to 5 are fragmentary, diagrammatic, elevational views of five phases of the formation of the tension-proof joint according to the invention.

Referring now to the figures of the drawing in detail, and first particularly to FIG. 1 thereof, there is seen the first phase in the formation of a tension-proof joint of two endless-fiber threads 1 and 2 which point in different directions. The ends of the threads lie side by side lengthwise and therefore form a common thread end 3, having an end section designated with reference symbol 3'. The thread end 3 already forms a loop 4 as seen in FIG. 1.

Figure 2:
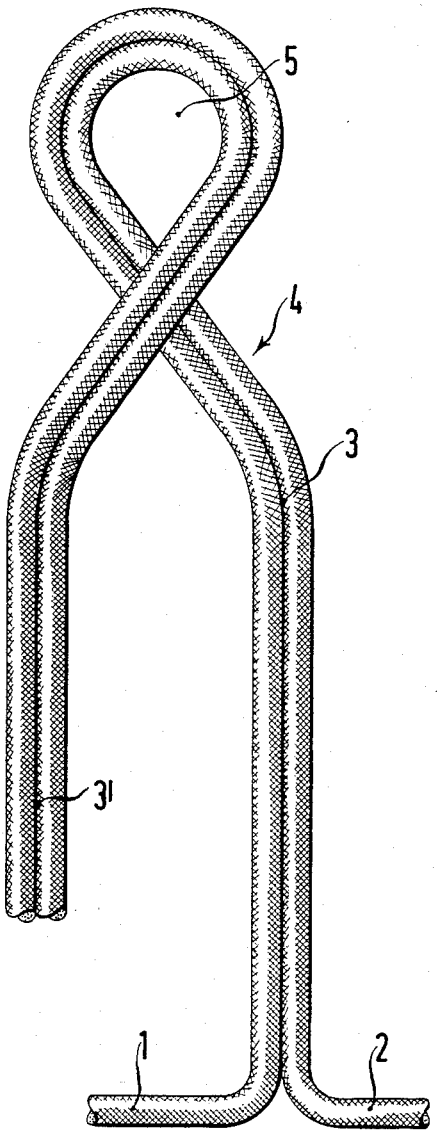

In the second phase according to FIG. 2, the loop 4 has already been twisted by a half-turn. A thread eye 5 has already been formed as well.

Figure 3:
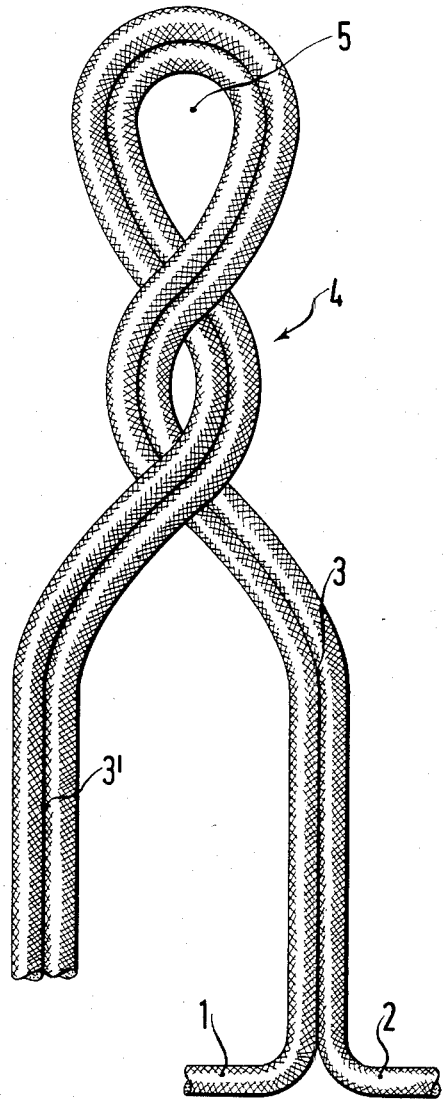

FIG. 3 shows the third phase in the formation of the joint. The loop 4 has already been twisted with a full turn.

Figure 4:
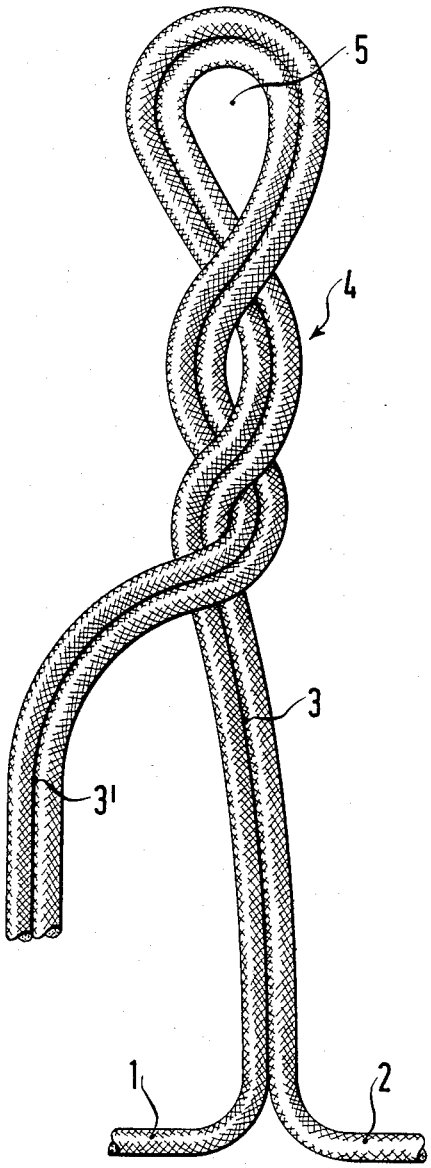

In the fourth phase according to FIG. 4, the loop has already been twisted with one and one-half turns. As seen from the side, the thread end 3 has crossed over itself three times.

Figure 5:
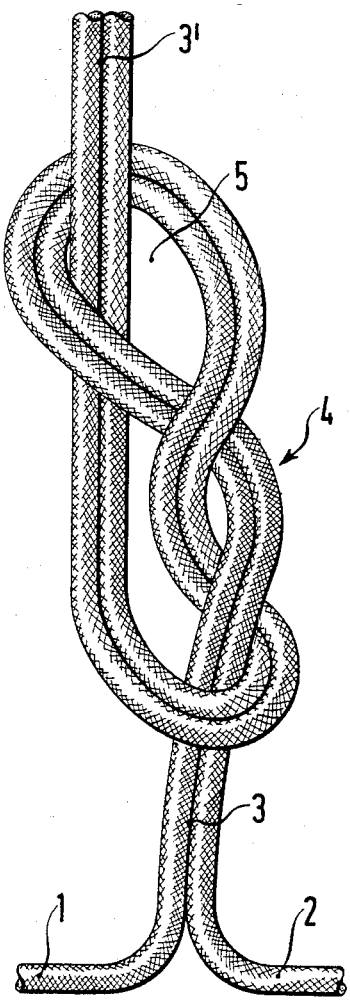

In the fifth phase of the formation of the joint shown in FIG. 5, the end section 3' of the thread end 3 is pushed through the thread eye 5, while the twist amounting to one and one-half turns is maintained. However, at this stage the end section has not yet been pulled through entirely and the joint has not yet been tightened. In order to form a durable joint, the loopings shown in FIG. 5 are pulled together as closely as possible by suitable thread tension. For the sake of a clearer presentation, this has not yet been done in FIG. 5.

Figure 6:
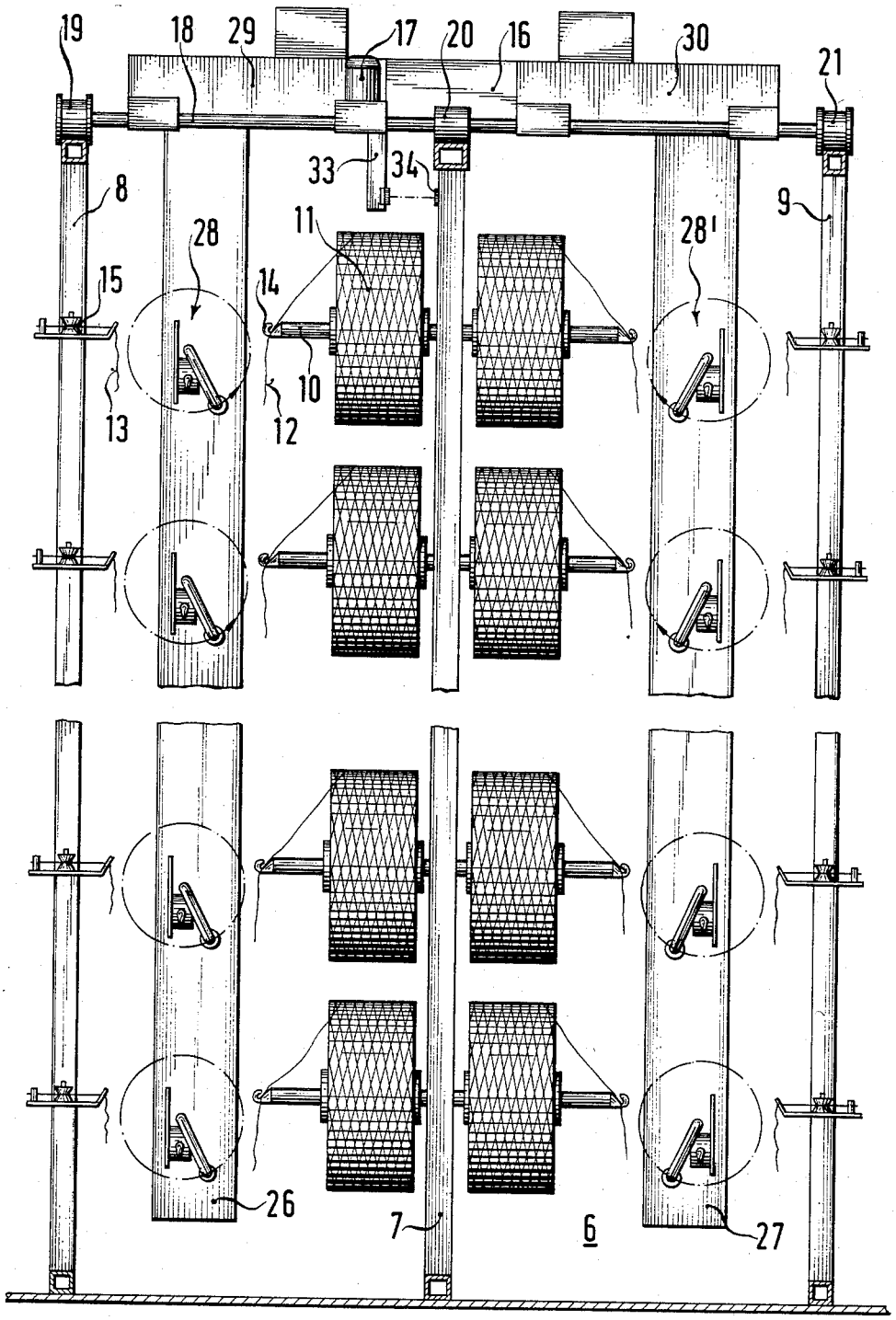
FIG. 6 is a partly cross-sectional front-elevational view of a carriage in a bobbin creel, equipped with devices for forming joints according to the invention.
Figure 7:
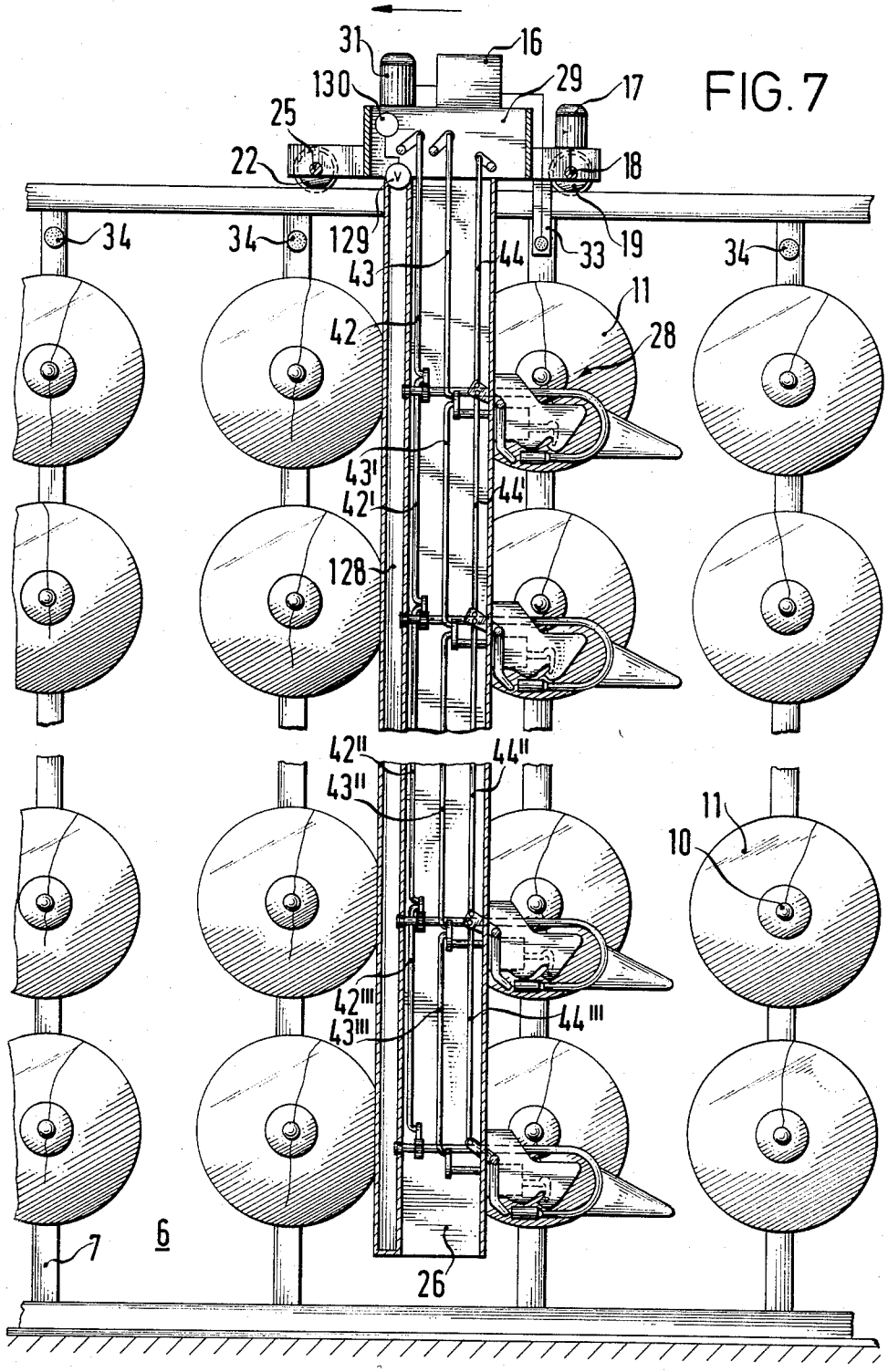
FIG. 7 is a fragmentary, side-elevational view of the carriage shown in FIG. 6.
Figure 8:
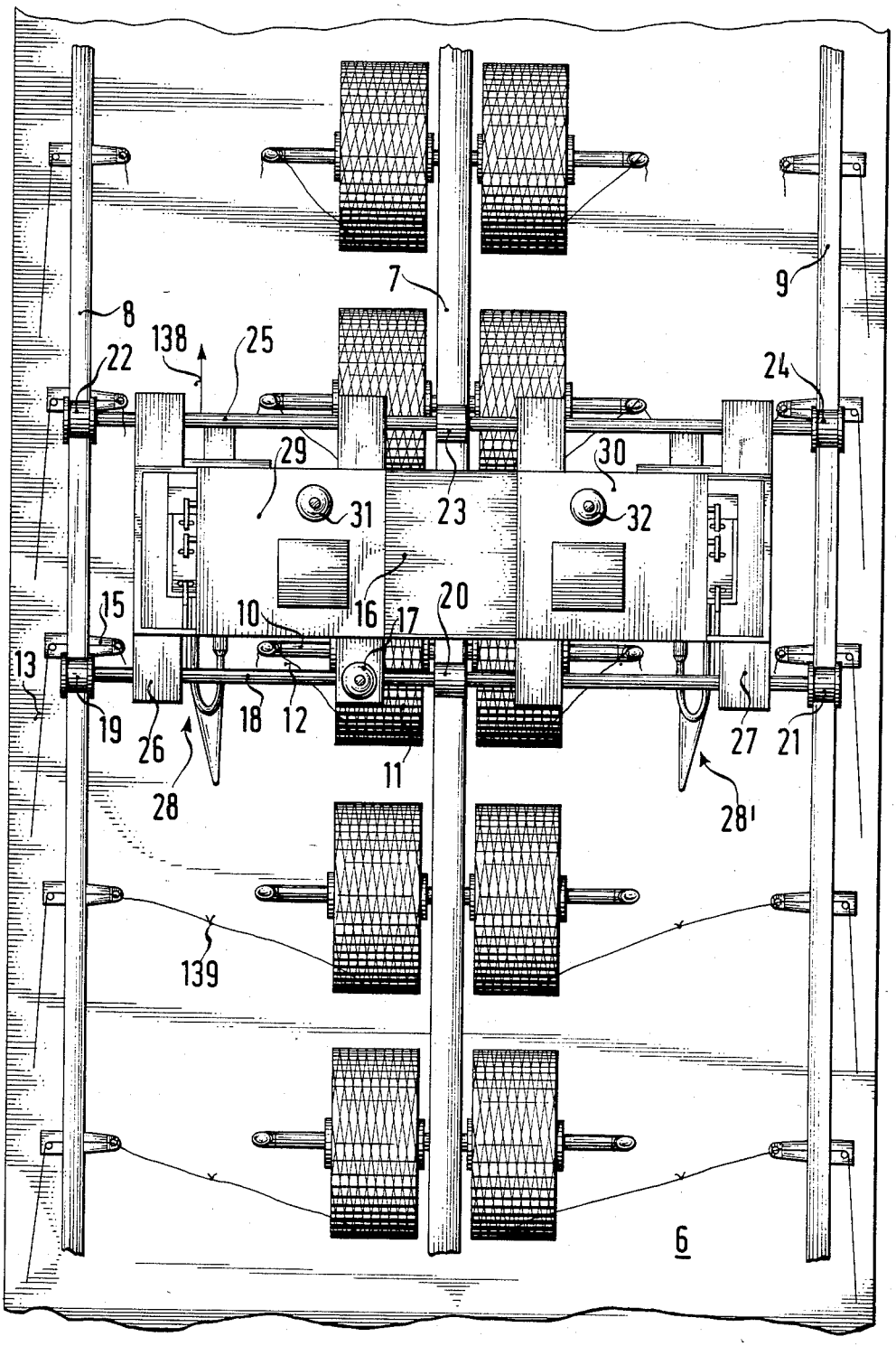
FIG. 8 is a fragmentary top-plan view of the carriage shown in FIG. 6.

FIGS. 6, 7 and 8 illustrate a bobbin creel or package cradle designated as a whole unit with reference numeral 6, a bobbin frame 7, and two tenter or stretcher frames 8 and 9 disposed opposite the bobbin frame to the left and right. The bobbin frame is equipped with identical bobbin holders 10 which support bobbins 11. The ends of threads 12 on the bobbins 11 hang from slots 14 which are formed in the ends of the bobbin holder 10.

The tenter frames 8 and 9 support identical thread tensioners 15. The ends of further threads 13 which are to be joined to the threads 12 hang from the thread tensioners 15. The threads 13 extend away from the creel to a non-illustrated winding machine. In the position shown in the drawings, the bobbin frames 7 have just been newly loaded and the winding operation must be interrupted until all of the thread joints have been made. The threads are endless-fiber threads.

A carriage 16 can run above the bobbin creel 6 on longitudinal members of the bobbin frame 7 and the tenter frames 8 and 9. To this end, the carriage 16 is provided with a shaft 18 which can be driven by a motor 17 and the shaft has rollers 19, 20, 21 fastened thereto. A further shaft 25 which carries further rollers 22, 23, 24 is also provided, but has no drive of its own.

The carriage 16 has two arms or crossbeams 26, 27 hanging down. Devices 28, 28' for making tension-proof joints are disposed on the arms 26, 27. The devices 28 are associated with the arm 26 and the devices 28' are associated with the arm 27. All of the devices 28 are of identical construction. The devices 28' are likewise identical to each other and only differ from the devices 28 by virtue of their mirror-symmetrical disposition and because the rotatable parts rotate in opposite direction. Since the bobbin creel 6 has a total of eight creel stories, but only four are shown in FIGS. 6 and 7, these figures each only show four devices 28 which are disposed vertically above each other. FIG. 6 additionally shows four devices 28' which are disposed vertically on top of each other. The individual devices are actuated by linkages from a location above, at which two individually driven program control devices 29 and 30 are disposed in the carriage 16. The program control device 29 is driven by a motor 31 and the program control device 30 is driven by a motor 32. The carriage 16 also has an opto-electrical position indicator 33 which responds to markings 34 located on the individual vertical beams of the bobbin frame 7. The position indicator 33 ensures that the carriage 16 can always be brought successively into an advantageous working position, so that the threads 12 of the bobbins 11 disposed vertically on top of each other can be joined to the ends of the threads 13 which are likewise located on top of each other.

The details of the device 28 which is shown particularly in FIGS. 9 to 11, will be explained in detail as a representation of all similar devices for making tension-proof joints.

The device 28 represents an assembly of the following devices: A joining device 35 with a rotatable tying bill 37 which has a controllable thread clamp 36; a device 38 for finding, fetching and holding the threads and for forming a common thread end; a device 39 for placing the thread end behind the tying bill 37; a device 40 for pulling the loop off the tying bill 37; and a controlled thread clamp 41. The above-mentioned program control device 29 shown in FIG. 9, is also part of the apparatus 28. The program control device 29 is responsible for causing all eight devices 28 (only four of which are visible) to make tension-proof joints. FIG. 9 shows that the program control device 29 is connected to the device 28 by three switching rods 42, 43, 44. FIG. 7 shows that the connection between the individual devices 28 is made by further switching rods 42', 42'', 42''', 43', 43'', 43''' and 44', 44'', 44''', respectively. Individual switching rods are provided instead of common continuous switching rods because this advantageously increases the number of devices 28 on top of each other as desired, in modular form.

The program control device 29 has a combined cam/-gear transmission 45 with gears 46 to 49 and cams 50, 51 and 52. The gear 46 and the cams 50 and 51 are mounted on a common shaft 53. The gear 49 and the cam 52 are mounted on a common shaft 54. All of the gears mesh with each other. An angle lever 55 is loaded by a wound spiral spring 57 and rests against the cam 50 with a feeler roll 60. The switching rod 42 is linked to the other end of the angle lever 55. An angle lever 56 is loaded by a wound spiral spring 58 and rests with a feeler roll 61 against the cam 52. The angle lever 56 is linked to the switching rod 44. A two-armed lever 62 is loaded by a wound spiral spring 59 and rests against the cam 51 with a feeler roll 63. The other end of the lever 62 is linked to the switching rod. 43.

Figure 10:
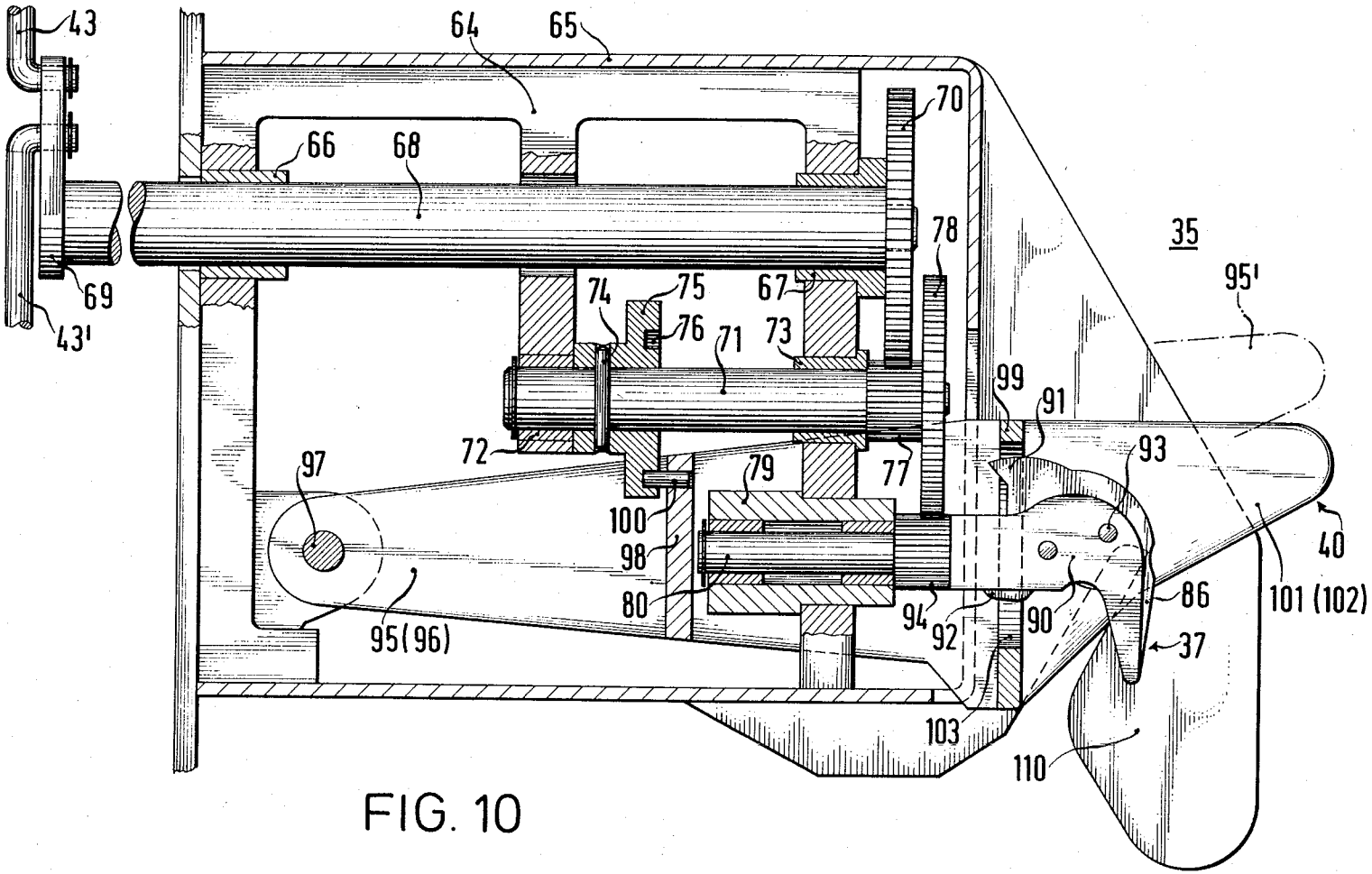
FIG. 10 is a fragmentary, cross-sectional view of the device shown in FIG. 9, including details of the operation of the tying bill.

The joining apparatus 35 which is shown particularly in the cross-sectional view of FIG. 10, includes a support frame 64 which is surrounded by a sheet metal housing 65. A shaft 68 is supported in bearings 66, 67 in the support frame 64. The shaft carries a lever 69 at one end thereof, on which the switching rods 43, 43' are articulatingly hung. The other end of the shaft 68 supports a gear 70.

A second shaft 71 is supported in the support frame 64 in sliding bearings 72 and 73. A disc 75 is fastened on the shaft 71 by a pin 74 and a control slot 76 is formed in the disc 75. The shaft 71 also supports a pinion 77 which meshes with the gear 70. The shaft 71 furthermore carries a gear 78 at the end thereof.

The support frame 64 also carries an antifriction bearing 79. A shaft 80 which carries the tying bill 37 is supported in the bearing 79. The tying bill 37 includes the above-mentioned thread clamp 36. The thread clamp 36 of the tying bill 37 is constructed as clamping scissors. Accordingly, the tying bill 37 is formed of three parts, namely, a first outer bill part 82 shown in FIG. 20 which is provided with a cutting edge 81 and a base 83 connected to the shaft 80 by a screw 84; a tiltable middle knife 86 which has a tilting device 85, a dull back 87 and a sharp knife edge 88; and a second outer bill part 90 which has dull edges 89. The dull edges 89 are knurled. The tilting device 85 has two switching vanes 91, 92, the purpose of which will be explained below. The tilting axis of the middle knife 86 is designated with reference numeral 93 in FIG. 20. The base 83 is constructed as a spring element so that all of the parts of the bill rest flat and resiliently against each other. The shaft 80 additionally carries a pinion 94 which meshes with the gear 78.

The support frame 64 also carries the device 40 for pulling the loop off the tying bill 37. The device 40 has two long levers 95, 96 which are pivoted at the support frame 64 by a joint pin 97. The two levers 95, 96 are connected to each other by straps 98, 99. The strap 98 carries a control pin 100 which engages in the control slot 76 formed in the cam 75.

The lever 95 ends in a thread guide vane 101 which can be moved up and down, and the lever 96 ends in a thread guide vane 102 which can be moved up and down.

Figure 20:
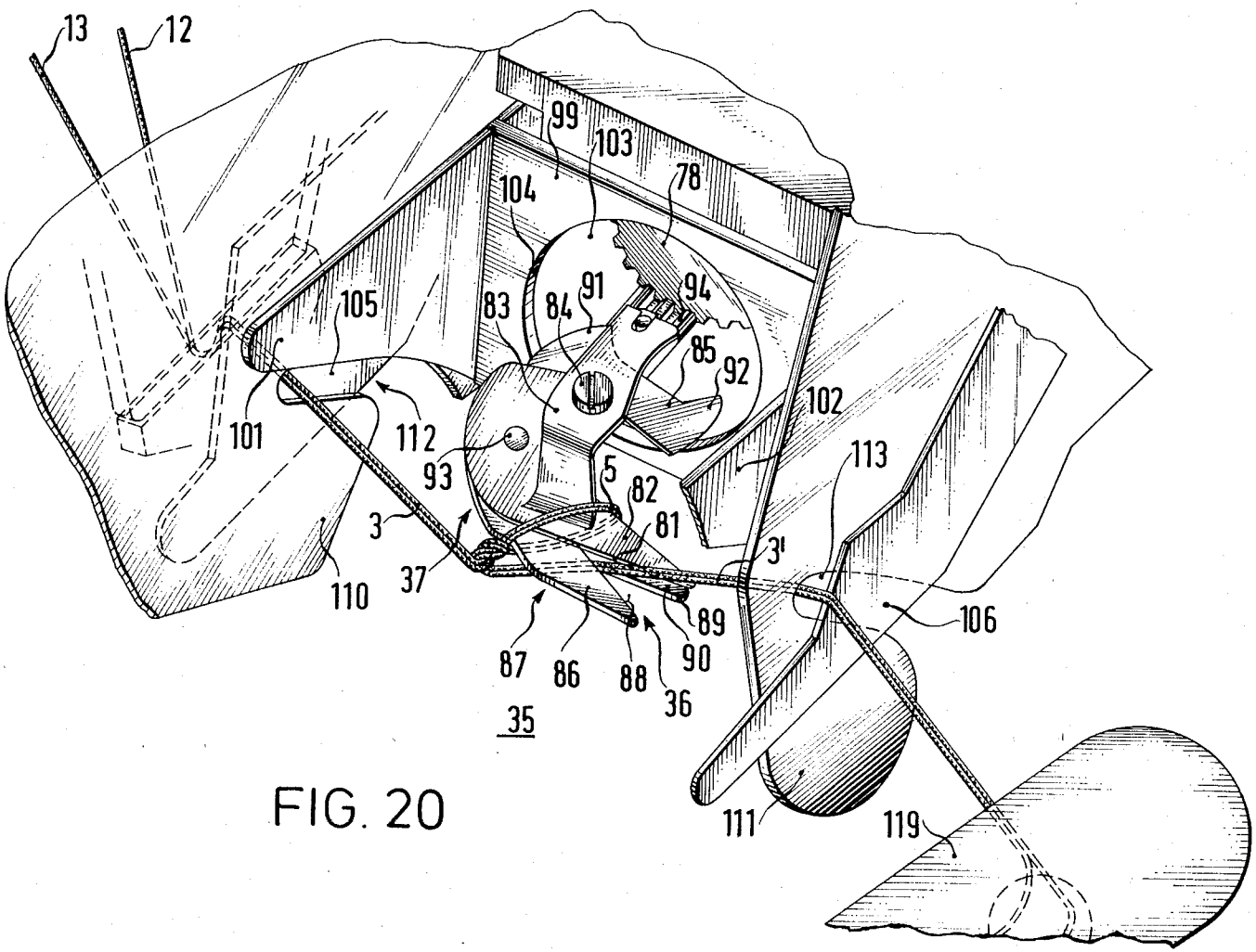

The device 40 for pulling the loop off the tying bill 37 is combined with a device for opening and closing the thread clamp 36. The strap 99 acts as the device for opening and closing the thread clamp. The strap 99 or the device for opening and closing the thread clamp 36, has an opening 103 formed therein, through which the tying bill 37 is pushed. More specifically, the tying bill is disposed in such a way that the two switching vanes 91, 92 of the tilting device 85 of the middle knife 86 are at the height of the opening 103 and an edge 104 of the opening 103 serves as a guiding contour for the switching vanes 91, 92, as seen in FIG. 20. Depending on the height of the device or the strap 99 and depending on the angular position of the tying bill 37, the thread clamp 36, which is constructed as clamping scissors, is open or closed.

Figure 9:
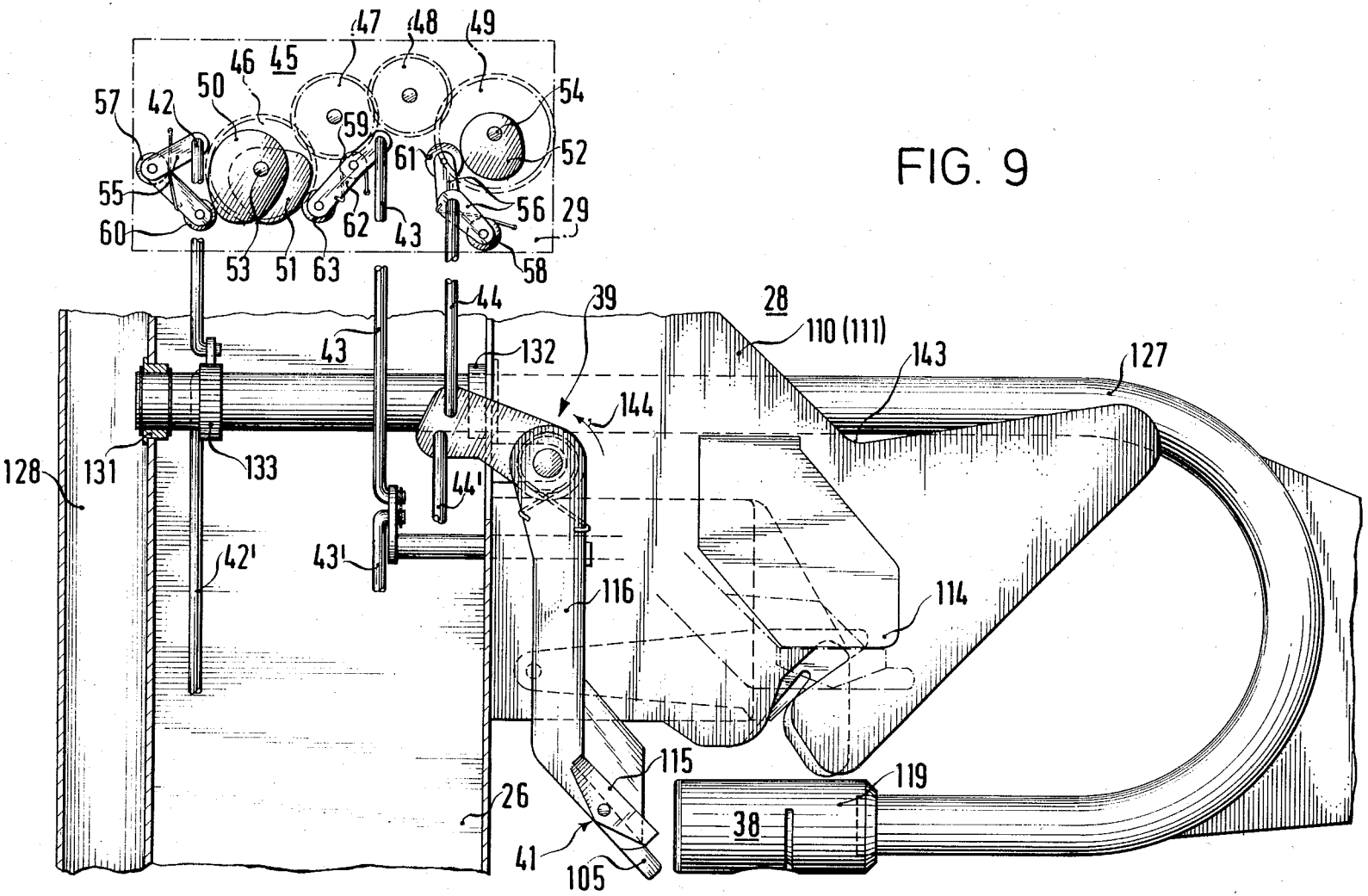
FIG. 9 is a fragmentary, partly cross-sectional, side-elevational view of an individual joining apparatus of the carriage shown in FIG. 6, including details of the program control device.
Figure 11:
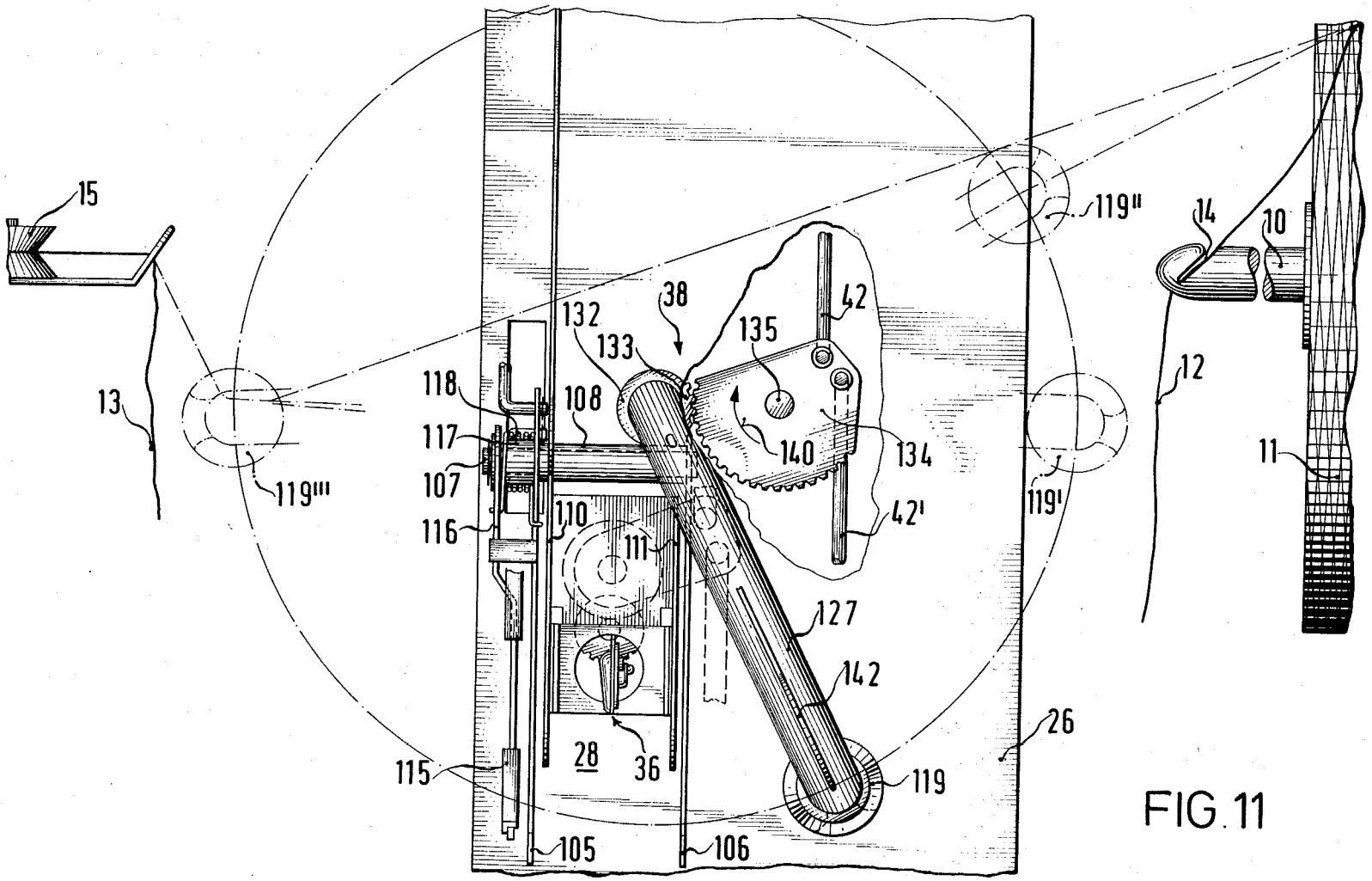
FIGS. 11 and 12 are fragmentary elevational views showing, in particular, details of the device for finding, fetching and holding the threads and for forming a common thread end.

According to FIGS. 9, 11 and 20, the device 39 for inserting the thread end 3 behind the tying bill 37 has two tiltable insertion arms 105 and 106 which are disposed laterally relative to the tying bill 37. The insertion arms 105 and 106 are mounted on a common shaft 107 that is supported in a tube 108 which is connected to the arm 26. The insertion arm 105 has an extension 109, to which the switching rods 44 and 44' are linked.

The two pivotable insertion arms 105, 106 cooperate with stationary thread guide slots 112, 113 formed in side walls 110, 111 as seen in FIG. 20. The slots codetermine the position of the thread end 3. The above-mentioned controlled thread clamp 41 is disposed at the point where the individual threads 12, 13 are combined into the common thread end 3. The thread clamp 41 is formed of an anvil 114 fastened to the side wall 110 and controlled clamp part 115 which is disposed on a lever 116. The lever 116 is fastened on a bushing 117 which is rotatably mounted on the shaft 107. A wound spiral spring 118 is provided in the form of a drag spring for the lever 117. As soon as the shaft 107 is rotated, the two insertion arms 105, 106 and the lever 116 swing upward until the clamp part 115 rests against the anvil 114. The drag spring 118 then goes into action, so that it continues to load the lever 116 and allows the two insertion arms 105 and 106 to swing further.

According to FIGS. 9 and 13 to 17, the device 38 for finding, fetching and holding the threads and for forming a common thread end has a movable thread suction head 119 with a suction opening 120. A controlled thread clamping device 121 is disposed in vicinity of the suction opening 120. The thread clamping device 121 is formed of a pneumatic valve which responds to underpressure. The pneumatic valve 121 has a valve disc 122, which is of conical shape. The valve disc or cone 122 is tapered against the flow direction and has an edge 123 which is forced to rest on a valve seat 125 by the force of a spring 124. The valve seat 125 is part of the thread suction head 119. The spring 124 is chosen so that the valve disc 122 is moved downward and its rim 123 is lifted off the valve seat 125 as soon as suction air flows in the direction of the arrow 126, as is indicated in FIG. 16.

According to FIG. 9, the thread suction head 119 is connected to a suction air canal 128 through a hollow body 127. According to FIG. 7, the suction air canal 128 ends at a controlled valve 129 which is connected to a suction air source 130. The hollow body 127 is in the form of a movable line and more specifically, a pivotable pipeline. The pivotable pipeline 127 is guided in sliding bearings 131, 132. The sliding bearings are fastened to the arm 26. A gear 133 is provided on the straight pipe section which is located between the bearings 131 and 132. The gear 133 meshes with a gear segment 134 as seen in FIG. 11. The gear segment 134 is mounted on a shaft 135. The switching rods 42 and 42' are movably linked to the gear segment 134.

The valve seat 125 has a recess 136 at one point thereof which prevents a thread from being clamped. A thread guiding slot 137 cut into the thread suction head 119 leads from the suction opening 120 to the recess 136.

As indicated in FIG. 8, the carriage 16 can be moved in the direction of an arrow 138 and against the direction of the arrow 138. The tension-proof joints are made by advancing the carriage 16 in the direction of the arrow 138. FIG. 8 shows four previously made joints 139. The joints become necessary due to a change of bobbins. Before the bobbin frame 7 is newly charged with bobbins 11, not all of the bobbins previously put in place have been run empty, and they still have threads of different sizes remaining. The bobbins with residue first have to be separated from the threads 13 leading to the winding machine. Separating the threads with the carriage 16 can be accomplished during passage against the direction of the arrow 138, if the carriage has suitable separating devices. However, such separating devices are not illustrated herein. As soon as the carriage 16 has travelled along the bobbin creel 6 and has opened all of the thread joints, the bobbin frame 7 is recharged, as is shown in FIG. 8. During the subsequent passage of the carriage 16 in the direction of the arrow 138, the tension-proof joints are then successively made. For this purpose, the carriage 16 stops in an advantageous working position next to a vertical row of bobbins due to the interaction of the position indicator 33 and the markings 34. The motors 31 and 32 are then switched on and the program control devices 29 and 30 are activated.

Through the use of the embodiments according to FIGS. 9 to 21, the individual operating steps which lead to the tension-proof joint will now be described in greater detail.

At first only the switching rod 42 is moved downward by means of the cam 50 and the angle lever 55. The motion of the switching rod 42 is also communicated to the switching rods 42', 42'' and 42'''. In this way, all the individual devices disposed on top of each other at the arm 27 are simultaneously actuated. According to FIG. 11, the gear segment 134 is turned in the direction of the arrow 140. The gear 133 then turns in the opposite direction and moves the hollow body 127 and accordingly the thread suction head 119 as well, from the base position shown, up to the position 119' shown in phantom. The program control device 29 then opens the controlled valve 129 shown in FIG. 7, so that the suction air canal 128 is connected to the suction air source 130. All intermittent suction air flow therefore travels in the direction of the arrow 141 in FIG. 14 through the hollow body 127, so that the pneumatic valve and the thread clamping device 121 are opened. The thread 12 from the bobbin 11, which hangs down from the slot 14 in the bobbin holder 10, is taken along into the suction opening 120. As soon as the thread suction head 119 has reached the position 119'' during the further swing of the hollow body 127, the controlled valve 129 is closed again. The pneumatic valve 121 therefore also closes spontaneously and clamps the thread 12 between the valve seat 125 and the rim 123 of the valve disc 122. During the further swing of the thread suction head 119 to the position 119'', the thread 12 is pulled out of the slot 14 and is also pulled off the bobbin 11 and dragged along. A vane or lug 142 fastened to the curved section of the hollow body 127 serves as a thread deflector. As soon as the phantom position 119'' is reached, the program control device 29 again opens the controlled valve 129 and, according to FIG. 16, a new intermittent suction air pulse travels in the direction of the arrow 126 through the hollow body 127. In the process, the thread 13 which hangs down from the thread tensioner 15 is also suctioned into the suction opening 120. After the subsequent closing of the controlled valve 129, the thread 13 is clamped and held. While the thread suction head 119 was moving from the position 119' to the position 119'', the thread 12 travelled along in the thread guide slot 137 due to the thread tension, and finally entered into the recess 136 upon the occurrence of a new intermittent suction air pulse. The thread remains in this position, no longer clamped, even after the pneumatic valve 121 is closed again. The thread therefore can be retracted over a distance from the hollow body 127 if it becomes necessary later when the thread connection is made. The cross-sectional view of FIG. 17 shows the position of the sucked-up threads 12 and 13 after the second intermittent suction air pulse. The longitudinal section through the thread suction head 119 according to FIG. 16 also shows the position of the two threads, but still during the second intermittent suction air pulse.

Figure 12:
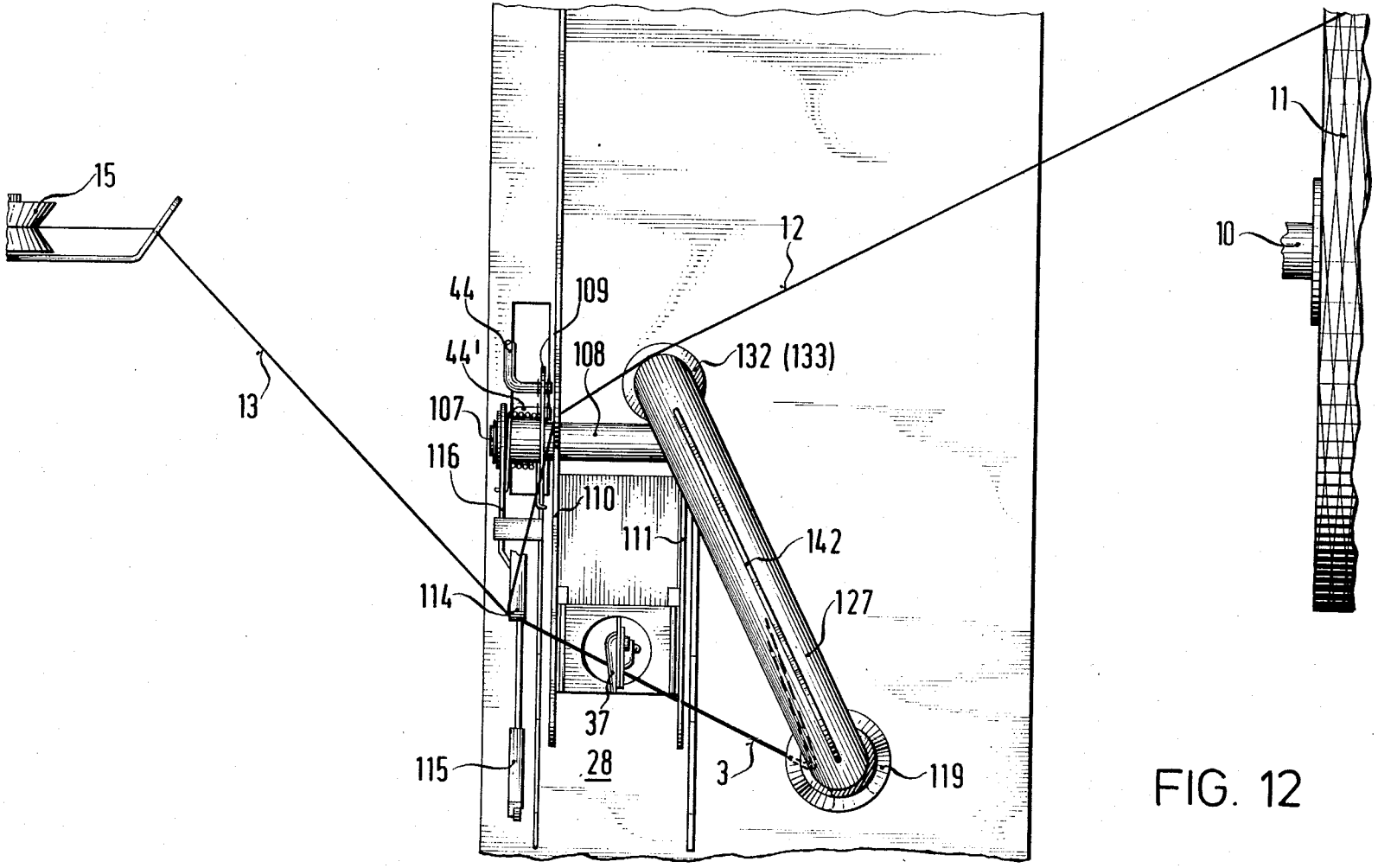

The gear segment 134 is rotated in the direction of the arrow 140 until the hollow body 127 has described a full circle and is again in the starting position as shown in FIG. 12. The thread 12 touches the upper part of the hollow body 127 from the outside. The thread 12 lies in a saddle 143 formed in the side wall 110 as seen in FIG. 9, and is combined at the anvil 114 with the thread 13 to form a common thread end 3. The tying bill 37 is in the base position with its tip pointing downward. The thread end 3 has already arrived behind the tying bill but is not yet in a position favorable for the formation of the joint.

Figure 18:
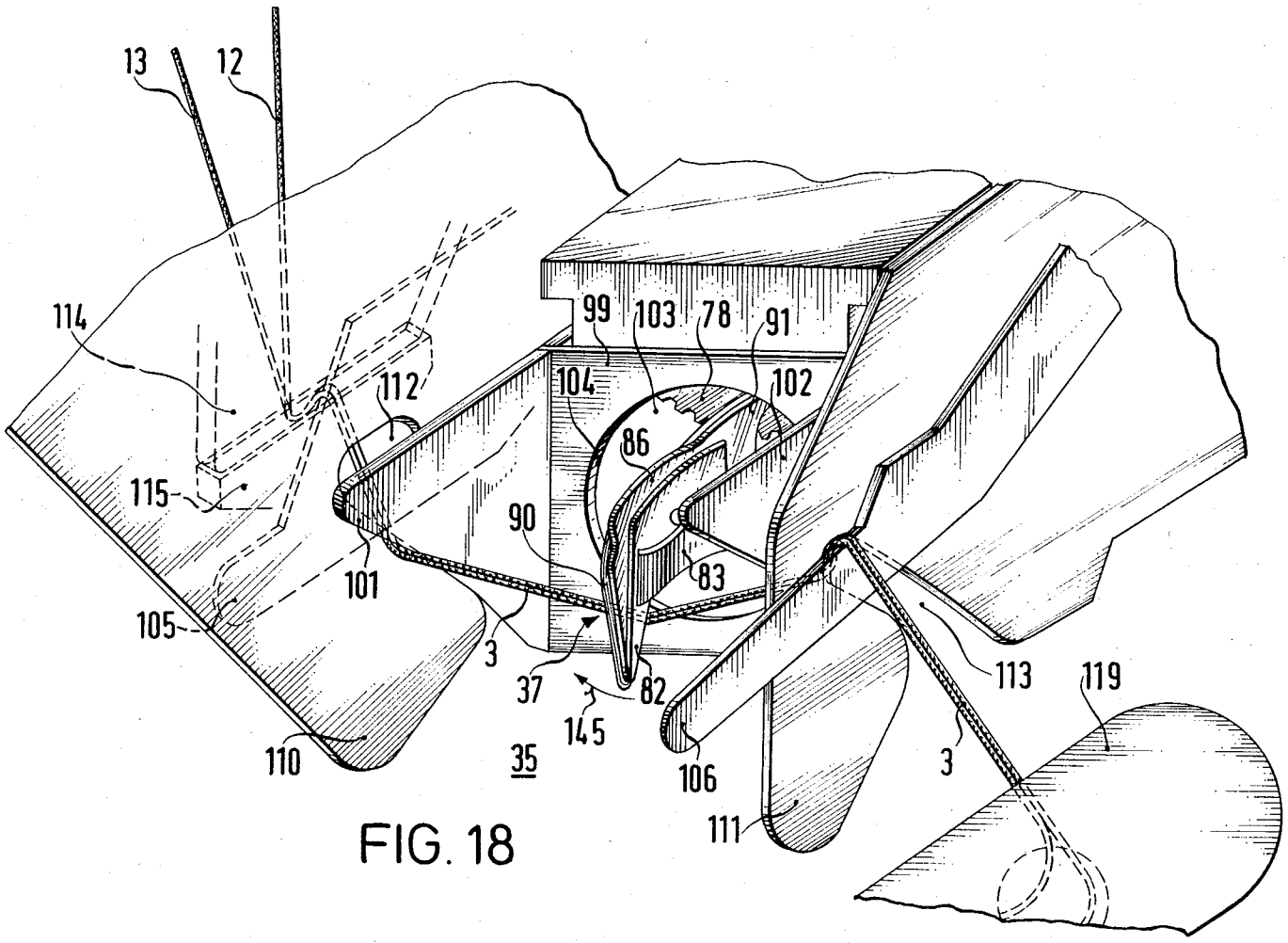
FIGS. 18 to 21 are fragmentary perspective views showing formation of a thread joint in four phases by means of the device shown in FIG. 6.

After the common thread end 3 is formed, the device 39 for inserting the thread end 3 behind the tying bill 37 is activated. To this end, the angle lever 56, which pushes the switching rod 44 downward, is moved by means of the cam 52. According to FIG. 9, the lever 116 and the two insertion arms 105 and 106 are swung in the direction of an arrow 144. The motion of the switching rod 44 is also transmitted to the switching rods 44', 44'' and 44'''. During the swing motion, the clamp part 115 first makes contact at the two threads which rest on the anvil 114 from below and clamps the two threads as seen in FIG. 18. When the extension 109 shown in FIG. 9 is swung further, the two inserting arms 105 and 106 engage the thread end from below, lift the thread end, insert it behind the tying bill 37 and into the thread guide slots 112, 113 and bring it into contact with the thread guide vanes 101 and 102 from below. This position of the common thread end 3 is shown in FIG. 18.

In the meantime, the joining apparatus 35 has remained in the rest position. The tip of the tying bill 37 points downward and, according to FIG. 10, the two levers 95 and 96 are in the lifted phantom position 95'. In this position, the bar 99 is lifted and the lower edge of its opening 103 pushes on the switching vane 92, so that the thread clamp 36 of the tying bill 37 remains closed.

Figure 19:
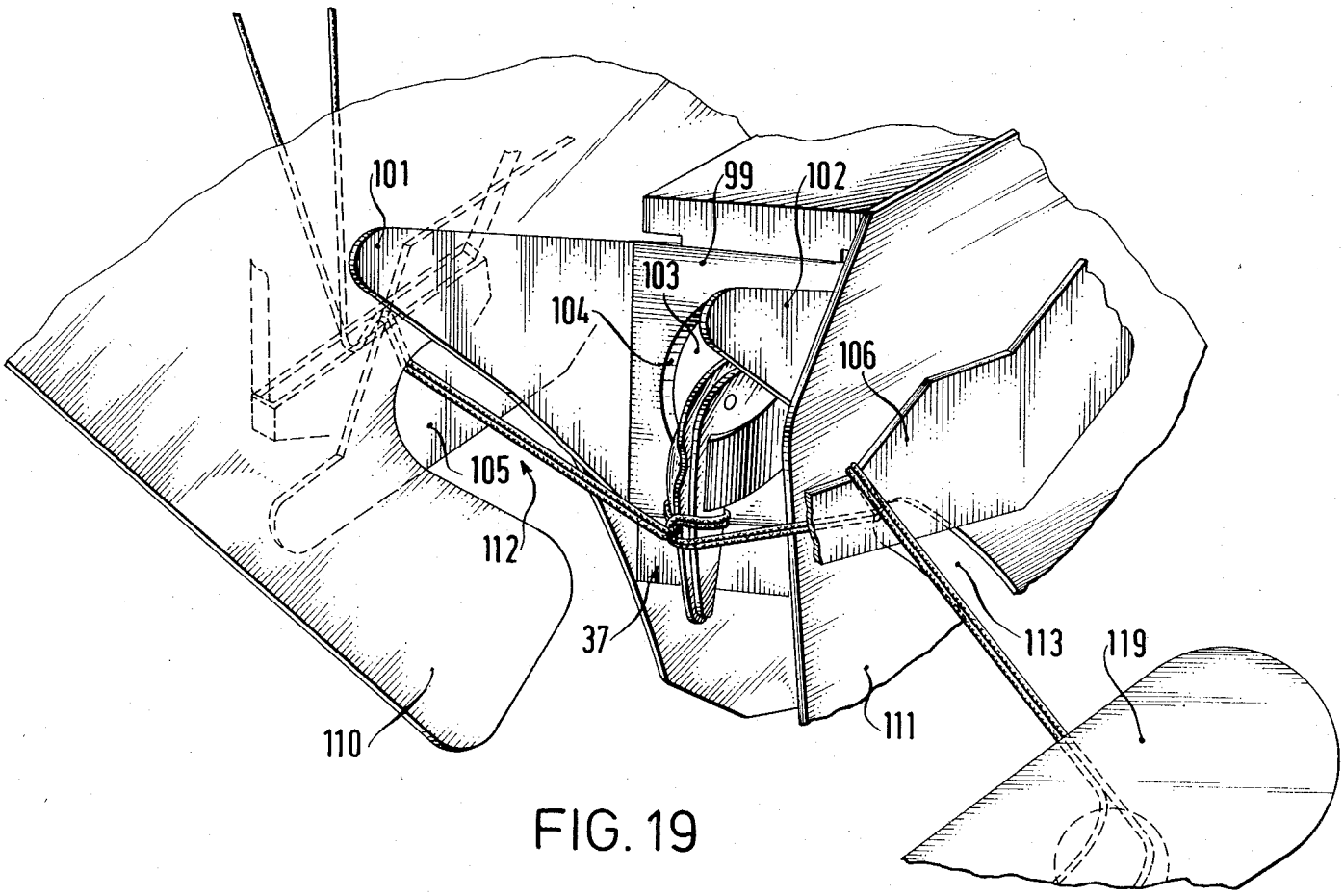
Figure 21:
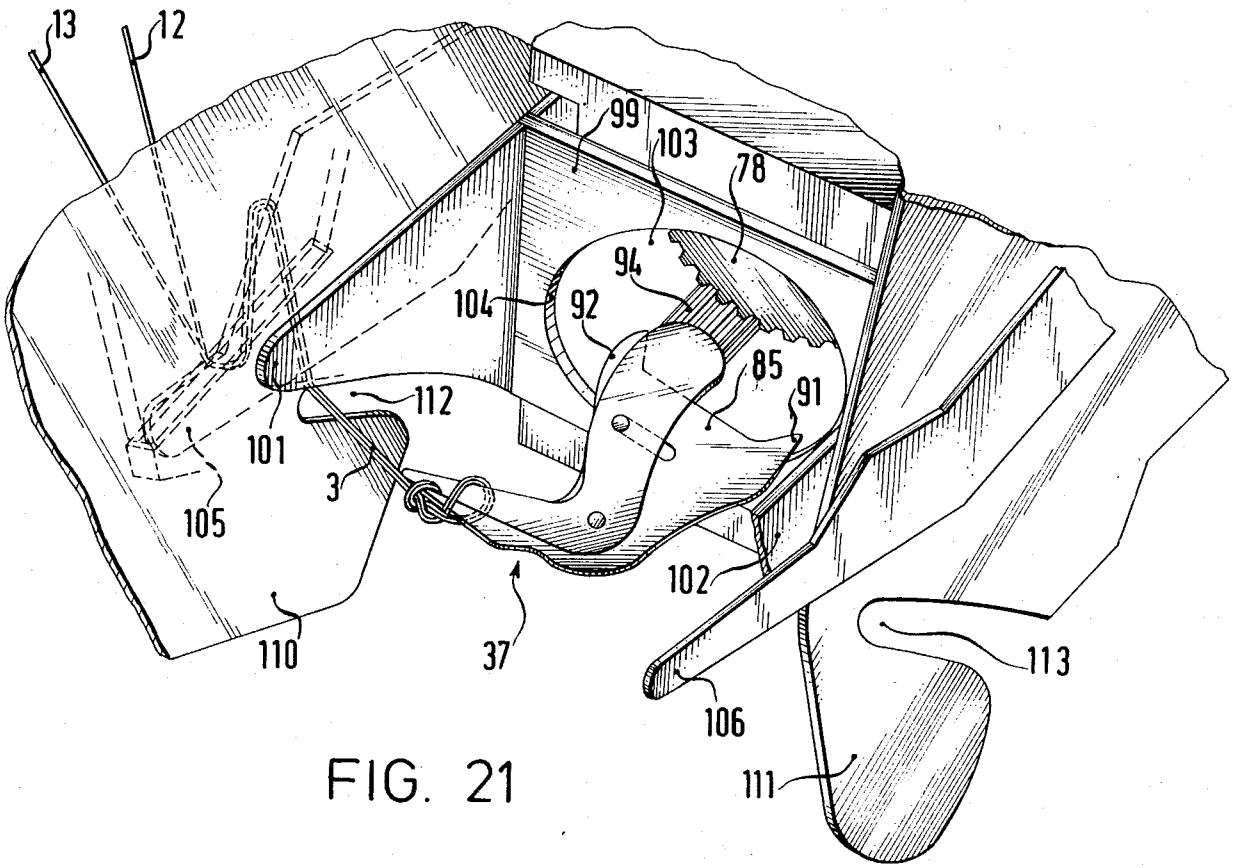

While the thread suction head 119 stops in the position which it has reached, the joining apparatus 35 is activated, and the switching rod 43 is moved downward by the two-armed lever 62 under the influence of the cam 51. The motion of the switching rod 43 is also communicated to the switching rods 43', 43'' and 43'''. Since the swing motion of the lever 69 is set-in, the shafts 68, 71 and 80 and the gears fastened thereto are turned, so that now the tying bill is rotated from the base position shown in FIG. 18 in the direction of an arrow 145, i.e., clockwise. The tying bill 37 then initially forms the first loop 4 from the thread end 3, which is finally twisted and forms a thread eye 5 as shown in FIG. 5. FIG. 19 shows the position of the tying bill 37 after one full revolution. The rotary motion of the tying bill 37 continues, however, until it has executed more than one and one-half and less than two turns. The device 99 is then activated in the sense that it opens the thread clamp 36. To this end, the device or strap 99 is lifted further according to FIG. 20, so that the switching vane 91 comes into contact with the rim 104 of the opening 103 and the middle knife 86 is opened, as is shown in the drawing. At this time, the thread end 3 has been given a one and one-half turn twist as shown in FIGS. 4 and 20. By further rotating the tying bill 37 in the clockwise direction, the thread clamp 36 constructed as clamping scissors is closed again, and the end piece 3' of the thread end which is now unnecessary, is cut off. The thread end itself, however, is still held by the thread clamp 36. The tying bill 37 does not interrupt its rotary motion and continues to turn until it has executed about two and one-quarter revolutions. Upon further rotation, the switching vane 92 comes into contact with the rim 104 of the opening 103, so that the thread clamp 36 must close of necessity, as is shown in FIG. 21. However, the thread joint is not yet completed. It is necessary to pull the end section 3' through the thread eye 5, as is shown in FIG. 5. This is done while the thread eye is slipped off the tying bill 37. To this end, the device 40 is activated, the insertion arms 105, 106 are run up and the thread guide vanes 101, 102 are run into the lowest position shown in the drawing. The thread guide vanes 101, 102 push onto the thread end 3 from above. Since it is made very difficult to bring the threads up through the closed controlled thread clamp 41, the thread eye 5 slides off the tip of the tying bill 37 while the thread clamp 36 still holds the outermost end. The interlacing of the thread end is therefore firmly pulled together. The tension-proof joint of the two endless-fiber threads 12 and 13 is then made. The program control device 29 then performs all of the motions in order to run down once more in the opposite sequence and in reverse. The threads therefore become free of the joining device 35. In the course of this resetting motion, the carriage 16 continues to travel to the next point of use and the succeeding intermittent suction air pulse causes the end section 3' of the thread end 3 which is separated and held by the thread suction head 119 to be suctioned into the suction air canal 128 as well.

The invention is not limited to the embodiments shown and described. Thus, for instance, the device for pulling-off the thread eye can also be combined with the device for forming a common thread end or it can be supported by this device. Rotatable parts of the device for making tension-proof joints can alternatively be driven by tension gears instead of linkages. A return motion for the purpose of zero setting could then be avoided.

The foregoing is a description corresponding in substance to German Application No. P 32 35 135.6, dated Sept. 23, 1982, the International priority of which is claimed for the instant application and which is hcreby made part of this application. Any material discrepancies between the foregoing specification and the aforementioned corresponding German application are to be resolved in favor of the latter.

I claim:

1. Apparatus for forming tension-proof joints in endless threads pointing in different directions, comprising a program control device for coordinating operation of the apparatus, a device connected to said program control device for finding, fetching and holding the threads pointing in different directions and for forming a common thread end with the ends of two threads lying adjacent each other in lengthwise direction, a joining device having a tying bill connected to said program control device for twisting the common thread ends of the threads into thread loops, a thread clamp of said tying bill for holding the common thread ends at least during rotation of said tying bill, a device connected to said program control device for placing the common thread ends behind said rotatable tying bill for twisting, and a device connected to said program control device for pulling the thread loops in the common thread ends off said tying bill.

2. Appararus according to claim 1, including a device for opening and closing said thread clamp, being combined with said device for pulling off the thread loops.

3. Apparatus according to claim 1, wherein said device for finding, fetching and holding the threads and for forming the common thread end, includes a movable thread suction head having a suction opening formed therein and a controlled thread clamping device.

4. Apparatus according to claim 3, wherein said controlled thread clamping device is in the form of a pneumatic valve activated by negative pressure.

5. Apparatus according to claim 4, wherein said pneumatic valve is disposed in vicinity of said suction opening.

6. Apparatus according to claim 4, wherein said pneumatic valve includes a valve seat, and a valve disc having a rim, said valve disc being spring-loaded for biasing said rim against said valve seat and said rim being lifted off said valve seat by negative pressure.

7. Apparatus according to claim 6, wherein said valve disc is a cone being tapered against flow direction of the negative pressure.

8. Apparatus according to claim 6, wherein said valve seat has a recess formed at a given location therein for preventing a thread from being clamped, and said thread suction head has a thread guiding slot formed therein from said suction opening to said recess.

9. Apparatus according to claim 3, including a suction air source, a controlled valve connected to said suction air source, and a hollow body connected from said controlled valve to said thread suction head.

10. Apparatus according to claim 9, wherein said hollow body is a movable line.

11. Apparatus according to claim 10, wherein said movable line is a pivotable pipeline.

12. Apparatus according to claim 1, wherein said thread clamp of said tying bill is in the form of clamping scissors including a first outer bill part having a cutting edge, a tiltable middle knife having a dull back and a tilting device, and a second outer bill part having dull edges.

13. Apparatus according to claim 12, wherein said device for pulling the thread loops off said tying bill includes two thread guiding vanes being movable up and down in vicinity of said tying bill, and including a strap interconnecting said thread guiding vanes, said tilting device includes two switching vanes, said strap is in the form of a device for opening and closing said thread clamp having an opening formed therein defining a rim, said tying bill is extended through said opening with said switching vanes of said tilting device at the level of said opening, and said rim of said opening forms a guiding contour for said switching vanes.

14. Apparatus according to claim 1, including side walls having stationary guiding slots formed therein, said device for placing the common thread ends behind said tying bill including two pivotable insertion arms disposed laterally of said tying bill and interacting with said guiding slots for determining the position of said common thread end.

15. Apparatus according to claim 1, wherein said device for pulling the thread loops off said tying bill includes two thread guiding vanes being movable up and down in vicinity of said tying bill, and including a strap interconnecting said thread guiding vanes.

16. Apparatus according to claim 1, including a controlled thread clamp disposed at a given location where the threads form the common thread end.

17. Apparatus according to claim 1, wherein said program control device includes a combined cam and gear transmission.

* * * * *